United States Patent [19]

Kumagai

[11] Patent Number: 4,640,338

[45] Date of Patent: Feb. 3, 1987

[54] ROLLER APRON FOR CASTING OF SUPPORT-PRE-PROFILES OR SECTIONAL SHAPES AND BLOOMS IN A CONTINUOUS CASTING INSTALLATION

[75] Inventor: Ken Kumagai, Niihama, Japan

[73] Assignee: Concast AG, Zürich, Switzerland

[21] Appl. No.: 193,357

[22] Filed: Oct. 2, 1980

[30] Foreign Application Priority Data

Oct. 22, 1979 [JP] Japan ..... 54-146204

[51] Int. Cl.[4] ..... B22D 11/128

[52] U.S. Cl. ..... 164/448; 164/442

[58] Field of Search ..... 164/441, 442, 447, 448, 164/484; 72/225, 226

[56] References Cited

U.S. PATENT DOCUMENTS 3,500,673 3/1970 Wheeler et al. ..... 72/199 X 3,533,260 10/1970 Marcovitch ..... 72/225 X

FOREIGN PATENT DOCUMENTS 49-76760 7/1974 Japan ..... 72/226

*Primary Examiner*—Kuano Y. Lin

*Attorney, Agent, or Firm*—Werner W. Kleeman

[57] ABSTRACT

For the alternative guiding of an I-shape or dog bone profile or a bloom, roller members or rolls are mounted at two sides of a support. By rotating such support it is possible to positionally set those rollers best suited for the processing of the momentary type of strand which is being cast.

4 Claims, 4 Drawing Figures

ROLLER APRON FOR CASTING OF SUPPORT-PRE-PROFILES OR SECTIONAL SHAPES AND BLOOMS IN A CONTINUOUS CASTING INSTALLATION

BACKGROUND OF THE INVENTION

The present invention relates to a new and improved construction of roller apron or strand guide arrangement for the continuous casting of structural I-shapes or dog bone profiles and blooms in a continuous casting installation, especially for the continuous casting of steel.

There are already known to the art continuous casting installations for the alternative casting of an I-shape or dog bone profile and blooms. It is conventional practice to provide a roller apron or support guide arrangement with rollers for the guiding of the bloom. Depending upon the nature of the strand to be cast the roller aprons are dismantled and remounted or exchanged, respectively. Yet this is economically disadvantageous due to the necessary change-over work.

SUMMARY OF THE INVENTION

It is therefore a primary object of the present invention to overcome these drawbacks and disadvantages of the prior art.

Another and more specific object of the present invention is to construct a roller apron or strand guide arrangement such that both types of strands can be cast at a continuous casting installation without the need to dismantle the roller apron.

Yet a further important object of the present invention is to provide an improved construction of roller apron arrangement for a continuous casting installation which enables economically and reliably casting at the same installation and with the use of the same type of roller aprons different types of castings or cast sectional shapes.

Now in order to implement these and still further objects of the present invention, which will become more readily apparent as the description proceeds, the invention contemplates providing at two sides of a rotatable or pivotable support or carrier element a respective roller or roll for the guiding of a web of a dog bone profile or I-shape or a roller or roll for the guiding of a bloom.

With such type apparatus design there is possible the casting of the different types of strands as mentioned above in a most economical fashion, i.e. the casting operation can be carried out within a very short amount of time and with very little work.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
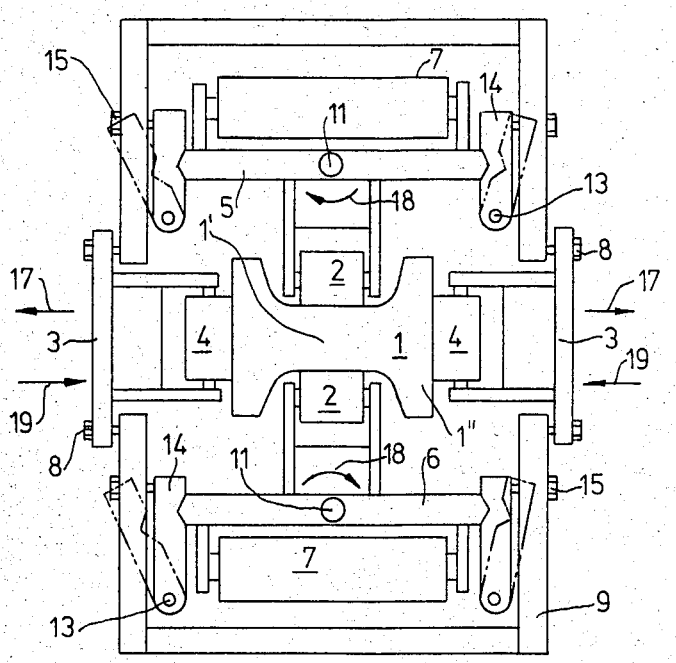
FIG. 1 is a top plan view of an embodiment of part of a roller apron according to the invention in a position ready for the continuous casting of a dog bone profile or I-shape.

Describing now the drawings it is to be understood that only enough of the continuous casting installation has been shown in order to enable those skilled in this technology to readily understand the underlying principles and concepts of the invention and to simplify the illustration of the drawings. Turning attention now to FIG. 1, there will be seen that in the secondary cooling zone of a continuous casting installation a dog bone profile or I-shape 1 is guided by rollers or rolls 2 at the profile web 1' and by rollers or rolls 4 at the sides of the flanges 1'' of such profile 1. The rollers 2 are mounted or journaled in each case at one side of the dog bone profile or I-shape 1 at an inner support member 5 and an outer support member 6, whereas the other rollers or rolls 4 are mounted at lateral support members 3. At the support members 5 and 6 there is mounted at the respective sides thereof facing away from the related roll or roller 2 a respective roller or roll 7 for the guiding of a bloom.

Additionally, it will be understood that the support members 3 are displaceably mounted at a frame 9 by means of adjustment or positioning screws 8 or equivalent structure.

Figure 2:
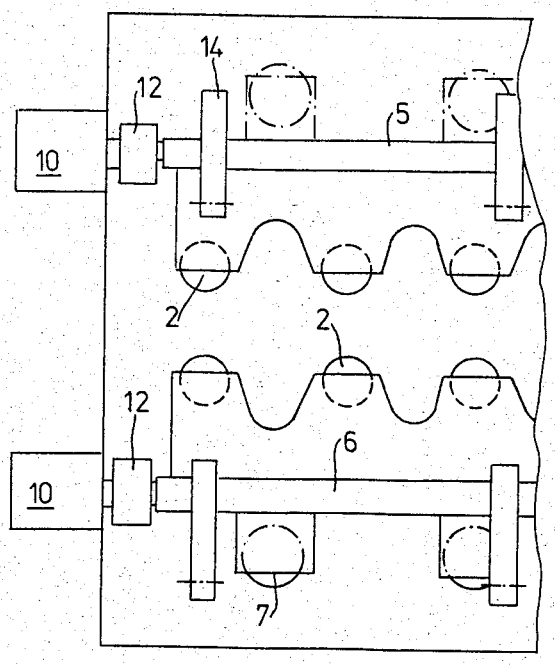
FIG. 2 is a front view of the arrangement of FIG. 1.

The support members 5 and 6 are rotatable about the shafts 11. The rotation of such support members 5 and 6 is accomplished, as best seen by referring to FIG. 2, by means of a drive 10. Reference character 12 designates the bearings for the shafts 11.

Holders 14 are provided at the frame 9 for the inner and outer support members 5 and 6. Reference character 15 designates fixing bolts or screws or equivalent structure which press the holder members or holders 14 against the support members 5 and 6 and prevent an undesired rotation thereof and position such support members 5 and 6.

Figure 3:
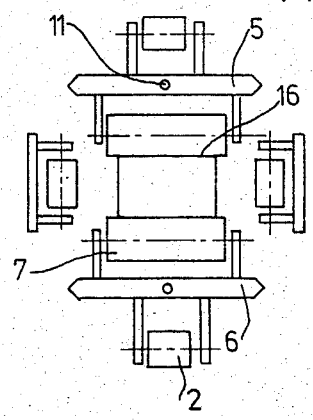
FIG. 3 is a top plan view of the same embodiment of roller apron arrangement of a continuous casting installation as shown in FIGS. 1 and 2, but now having the pertinent structure positioned for the casting of a bloom.

If it is intended to cast, instead of the illustrated dog bone profile or I-shape 1, a bloom sectional shape or format, then the adjustment screws or bolts 8 or equivalent structure are released and the flange rollers or rolls 4 are shifted in the direction of the arrow 17. Thereafter the threaded bolts or screws 15 are released, in order to release the holders or holder members 14 of the outer support member 6. Now the shaft 11 is rotated through 180° in the direction of the arrow 18 by means of the drive 10, so that the prior positions of the rollers 2 and 7 is interchanged. It is equally possible to manually rotate the shafts 11, and thus, these rollers or rolls 2 and 7. Then in the same manner the inner support member 5 is rotated. After having completed the rotation of both of the support members 5 and 6 they are now engaged by the holders 14 and such secured in place by means of the threaded bolts 15 or the like. FIG. 3 illustrates the final position of the roller apron, after there have been quickly and easily carried out these manipulations, and in a position ready for the continuous casting of blooms.

In the event the size of the bloom sectional shape permits guiding the strand at only one side, for instance, the external or outer side, then it would also be possible to omit the roller 7 at the inner support member 5.

When necessary, the lateral rolls 4 can be used for the lateral guiding of the bloom 16 by displacing the support members 3 in the direction of the arrow 19.

Figure 4:
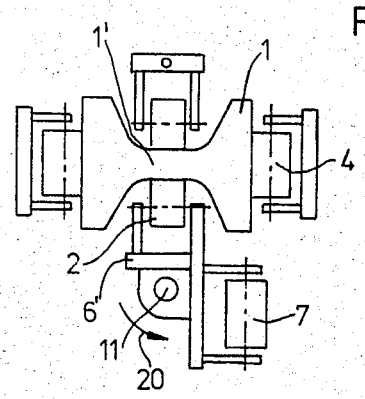
FIG. 4 is a top plan view of a further embodiment of the invention.

FIG. 4 illustrates a further embodiment of the invention, wherein in this case there are arranged at the outer support member 6' the roller or roll member 2 for guiding the web 1' of a a dog bone profile or I-shape 1 and at a further side of the support member 6' there is arranged a roller 7 for guiding the bloom 1. Upon changeover in the casting operation from one type of strand to another this support member 6' must be merely pivoted through 90° in the direction of the arrow 20, in order to thereby place the desired roller in its required work position. The opposite roller for guiding the web of the dog bone profile is omitted.

While there are shown and described present preferred embodiments of the invention, it is to be distinctly understood that the invention is not limited thereto, but may be otherwies variously embodied and practiced within the scope of the present invention.

Accordingly, what is claimed is:

1. A roller apron for the continuous casting of I-shapes and blooms in a continuous casting installation, comprising:

a movable roller support member having two sides; a roller member for guiding a web portion of an I-shape mounted at one side of the roller support member; and a further roller member for guiding a bloom arranged at the other side of said roller support member.

2. The roller apron as defined in claim 1, further including:

means mounting said roller members for rotatable movement so as to selectively place one or the other of said roller members into an effectual position at the casting.

3. The roller apron as defined in claim 1, further including:

means for mounting said roller members for pivotable movement so as to selectively place one or the other of said roller members into an effectual position at the casting.

4. The roller apron as defined in claim 1, wherein:

said roller members are supported by said movable roller support member so that they can be selectively brought into direct contact with the I-shape or bloom.

* * * * *